US007374450B1

(12) United States Patent
Chang

(10) Patent No.: US 7,374,450 B1
(45) Date of Patent: May 20, 2008

(54) HIGH FREQUENCY PLUG

(75) Inventor: Ray Chang, Hsichih (TW)

(73) Assignee: Telebox Industries Corp., Taipei Hsien (TW)

( * ) Notice: Subject to any disclaimer, the term of this patent is extended or adjusted under 35 U.S.C. 154(b) by 0 days.

(21) Appl. No.: 11/526,084

(22) Filed: Sep. 25, 2006

Related U.S. Application Data

(63) Continuation-in-part of application No. 11/447,051, filed on Jun. 6, 2006, now Pat. No. 7,175,468.

(51) Int. Cl.
*H01R 4/24* (2006.01)

(52) U.S. Cl. ..... 439/418

(58) Field of Classification Search ..... 439/418, 439/676, 941, 344, 660, 942, 445, 694, 678, 439/701, 495, 460, 404, 638, 354, 467, 455, 439/692, 894, 680
See application file for complete search history.

(56) References Cited

U.S. PATENT DOCUMENTS 6,524,128 B2 * 2/2003 Marowsky et al. ..... 439/418
6,561,838 B1 * 5/2003 Blichfeldt ..... 439/418
7,220,149 B2 * 5/2007 Pharney ..... 439/676

* cited by examiner

*Primary Examiner*—Edwin A. León
(74) *Attorney, Agent, or Firm*—Troxell Law Office, PLLC

(57) ABSTRACT

A high frequency plug formed of a housing, a load board and a cable organizer is disclosed. The cable organizer has top, bottom, left and right guide grooves for guiding the four twisted pairs of the cable, and a vertical opening hole in communication between the top and bottom guide grooves to enhance cross talk between the pair of the third and sixth wires and the pair of the fourth and fifth wire, thereby achieving de-embedded effect and improving the transmission quality. The cable organizer is molded from plastic with conductive material or EMI/RFI shielding material, eliminating interference and improving the transmission quality.

11 Claims, 26 Drawing Sheets

| | 1 | 2 | 3 | 4 | 5 | 6 | 7 | 8 | 9 | 10 | 11 | 12 | 13 | 14 | AVERAGE VALUE |
|---|---|---|---|---|---|---|---|---|---|---|---|---|---|---|---|
| A | 0.7 | 2.1 | 0.8 | 1.6 | 2.9 | 1.9 | 3.4 | 3.2 | 2.5 | 3.2 | 2.9 | 3.4 | 3.7 | 3.0 | 2.5 |
| B | 0.7 | 2.4 | 1.8 | 1.6 | 2.4 | 1.0 | 2.3 | 2.8 | 2.8 | 3.2 | 2.5 | 2.2 | 3.3 | 2.8 | 2.3 |
| | | | | | | | | | | | | | | | 2.4 |

Fig. 32

| | 1 | 2 | 3 | 4 | 5 | 6 | 7 | 8 | 9 | 10 | 11 | 12 | 13 | 14 | AVERAGE VALUE |
|---|---|---|---|---|---|---|---|---|---|---|---|---|---|---|---|
| A | 3.4 | -0.6 | 1.8 | 2.6 | -0.9 | -2.6 | 1.7 | 2.9 | -1.1 | -0.8 | -2.6 | -1.9 | 0.3 | 0.2 | 0.2 |
| B | 2.8 | -0.5 | 1.6 | 2.6 | -0.8 | -2.3 | 1.3 | 3.0 | -0.6 | -1.8 | -0.2 | -1.9 | 0.4 | -0.5 | 0.2 |
| | | | | | | | | | | | | | | | 0.2 |

Fig. 34

HIGH FREQUENCY PLUG

CROSS-REFERENCE TO RELATED APPLICATION

The present invention is a continuation-in part of U.S. patent application Ser. No. 11/447,051, filed on Jun. 6, 2006, now U.S. Pat. No. 7,175,468.

BACKGROUND OF THE INVENTION

1. Field of the Invention

The present invention relates to electric plugs and more particularly, to a high frequency plug, which is comprised of a housing, a load bar, and a cable organizer, wherein the cable organizer has top, bottom, left and right guide grooves for guiding the four twisted pairs of the cable and a vertical opening hole in communication between the top and bottom guide grooves to enhance cross talk between the pair of the third and sixth wires and the pair of the fourth and fifth wire, thereby achieving de-embedded effect and improving the transmission quality.

2. Description of the Related Art

In conventional high frequency plugs, the 8 wires (i.e., the 4 twisted pairs) may interfere with one another. High frequency plug manufacturers are trying hard to develop a high frequency plug that eliminates or significantly reduces interference.

FIG. 1 is a schematic view, partially in section, of a high frequency plug 6 according to the prior art before stamp of the holding down block 612 of the housing 61. FIG. 2 is a cross sectional view of FIG. 1. As illustrated, the twist pitch of the twisted pairs 74;75, 73;76, 71;72, 77;78 remains unchanged. However, when the holding down block 612 of the housing 61 is stamped against the cable 7, as shown in FIGS. 3 and 4, the bottom side 6121 of the holding down block 612 is pressed on the cable 7, causing deformation of the cable 7. At this time, the pitch among the twisted pairs 74;75, 73;76, 71;72, 77;78 is changed, affecting normal signal transmission.

SUMMARY OF THE INVENTION

The present invention has been accomplished under the circumstances in view. According to one aspect of the present invention, the high frequency plug is formed of an electrically insulative housing, a load bar, and a cable organizer. The cable organizer has top, bottom, left and right guide grooves for guiding the four twisted pairs of the cable, and a vertical opening hole in communication between the top and bottom guide grooves to enhance cross talk between the pair of the third and sixth wires and the pair of the fourth and fifth wire, thereby achieving de-embedded effect and improving the transmission quality.

According to another aspect of the present invention, the cable organizer is molded from plastic with electrically conductive material or EMI/RFI shielding material, eliminating interference and improving the transmission quality.

According to still another aspect of the present invention, the housing has a holding down block protruded from one peripheral wall of the locating slot. The holding down block has a smoothly arched top recessed portion against which a tool is driven to force the holding down block into the desired position to hold down the cable 4, maintaining the twist pitch of the twisted pairs and normal signal transmission function of the cable.

BRIEF DESCRIPTION OF THE DRAWING

FIG. 32 is a (dB) value statistic chart obtained from a test made on a high frequency plug sample constructed according to the present invention.

FIG. 34 is a (dB) value statistic chart obtained from a test made on a high frequency plug sample constructed according to U.S. patent application Ser. No. 11/447,051.

DETAILED DESCRIPTION OF THE INVENTION

Figure 2:
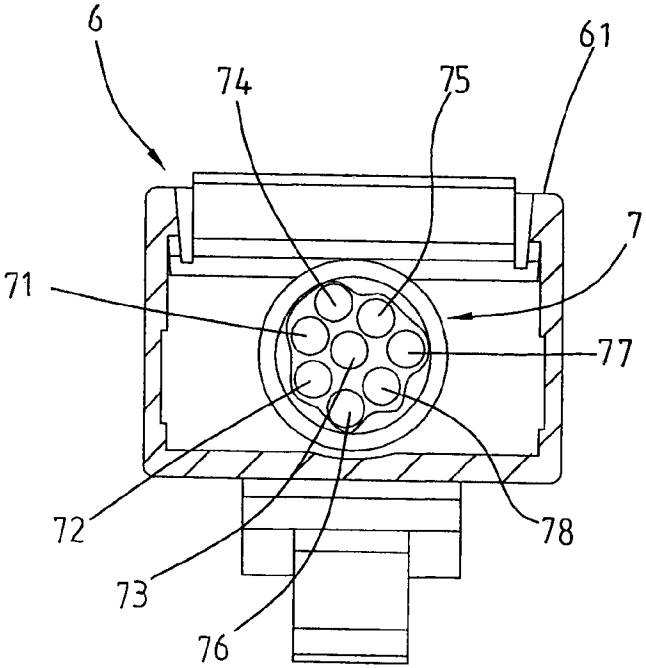
Fig. 2 PRIOR ART
FIG. 2 is a cross sectional view of FIG. 1.
Figure 1:
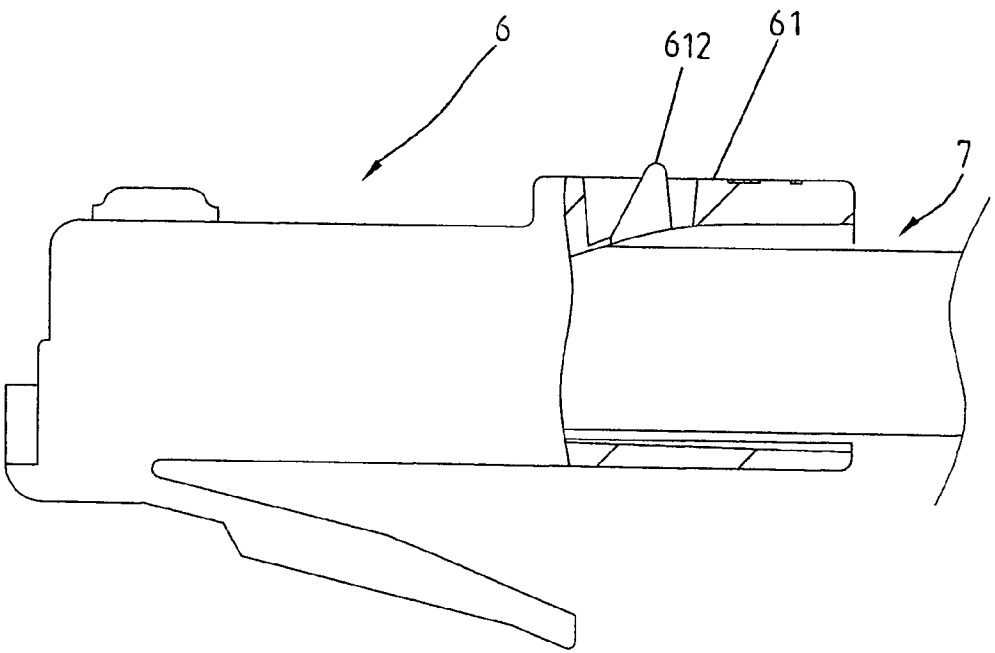
Fig. 1 PRIOR ART
FIG. 1 is a schematic view, partially in section, of a modular plug according to the prior art before stamp of the holding down block of the housing.
Figure 4:
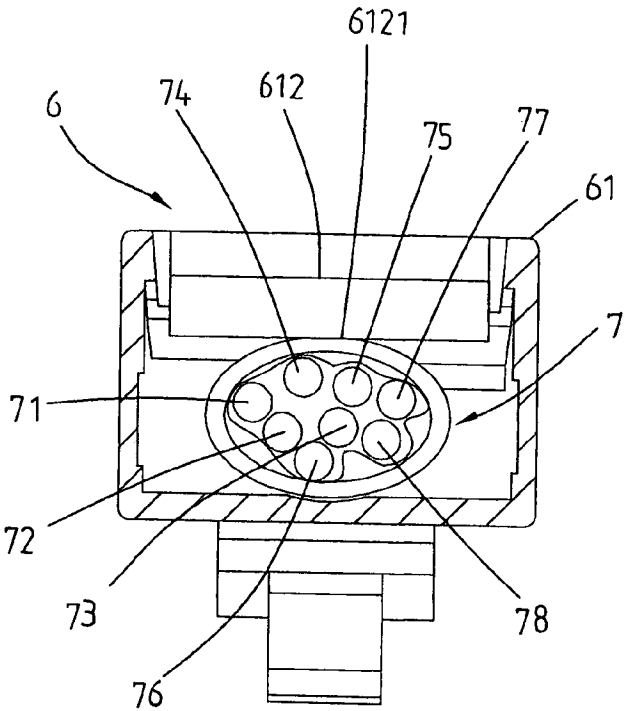
Fig. 4 PRIOR ART
FIG. 4 is a cross sectional view of FIG. 3.
Figure 3:
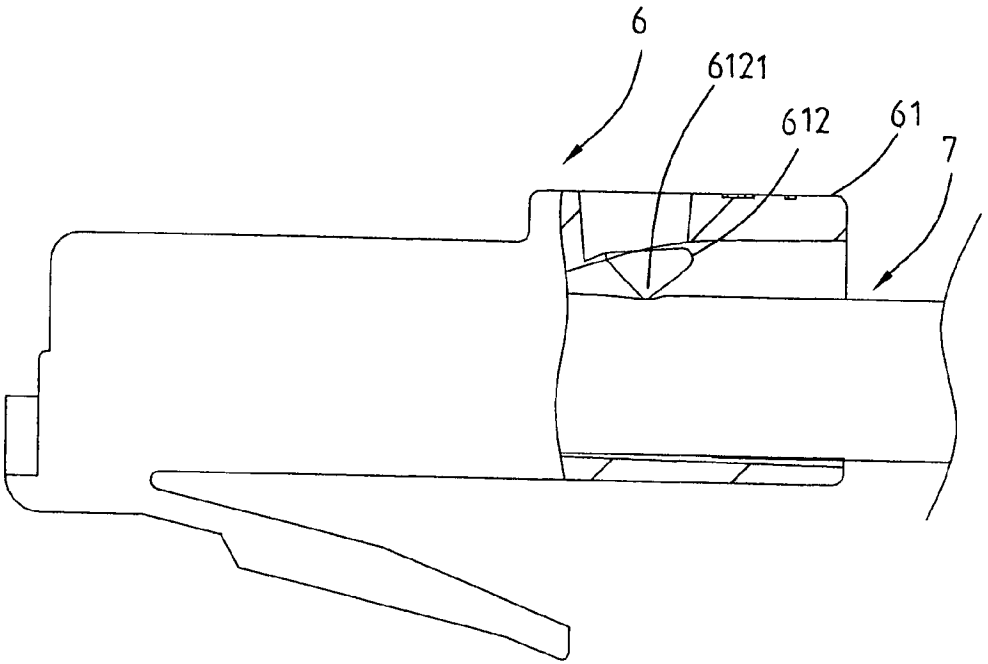
Fig. 3 PRIOR ART
FIG. 3 corresponds to FIG. 1, showing the status of the plug after stamp of the holding down block of the housing.

Referring to FIGS. 5~22, a high frequency plug in accordance with the present invention is shown comprised of a housing 1, a load bar 2, and a cable organizer 3.

The housing 1 is molded from plastics, having an accommodation chamber 11 that accommodates the load bar 2 and the cable organizer 3 (see FIG. 19), a rear opening hole 113 on the rear side in communication with the accommodation chamber 11, a locating slot 12 cut through the top wall in communication with the accommodation chamber 11, a holding down block 121 formed integral with one peripheral wall of the locating slot 12 and suspending in the locating slot 12 (see FIG. 20), and 8 wire slots 10 cut through the top wall in communication with the accommodation chamber 11 and arranged in parallel for the insertion of a respective metal contact 5. The holding down block 121 has a bottom edge 1210 that touches the periphery of the cable 4 that is inserted into the accommodation chamber 11 of the housing 1, and a smoothly arched top recess 1211 against which a hand tool or automatic stamping machine is operated to force the holding down block 121 into position where the holding down block 121 holds down the cable 4 (see FIGS. 21 and 22), preventing a change of the twist pitch of the twisted pairs 41,42; 43,46; 47,48 and ensuring normal signal transmission of the cable 4.

The load bar 2 has 8 wire slots 20 longitudinally formed in the front side and arranged in parallel, and a rear open chamber 21 in the tapered rear part (see FIGS. 5 and 6) in communication with the wire slots 20. The wire slots 20 each have the respective top side opened. The wires 41~48 are inserted through the rear open chamber 21 into the wire slots 20 respectively.

Figure 5:
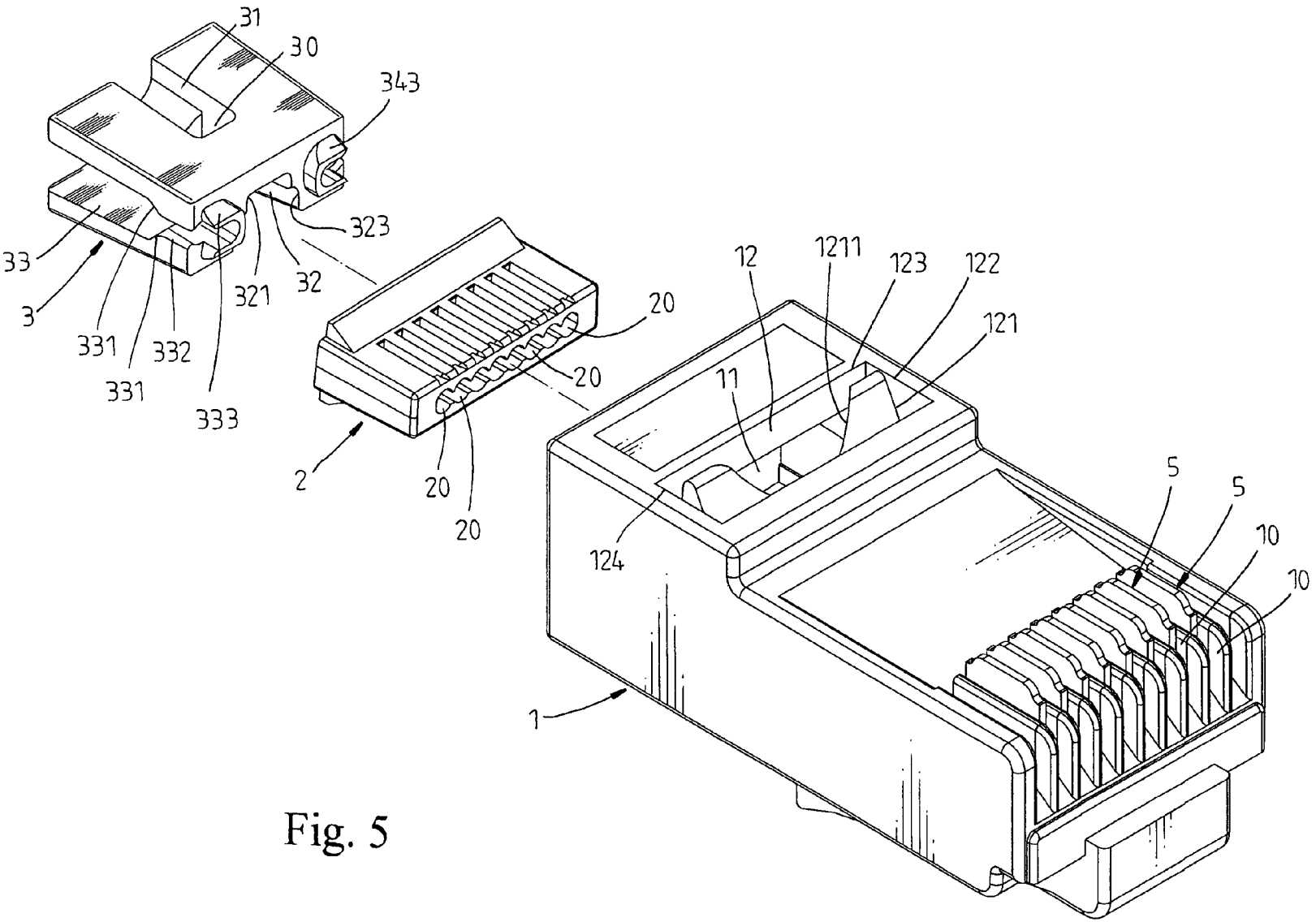
FIG. 5 is an exploded view of a high frequency plug according to the present invention.
Figure 6:
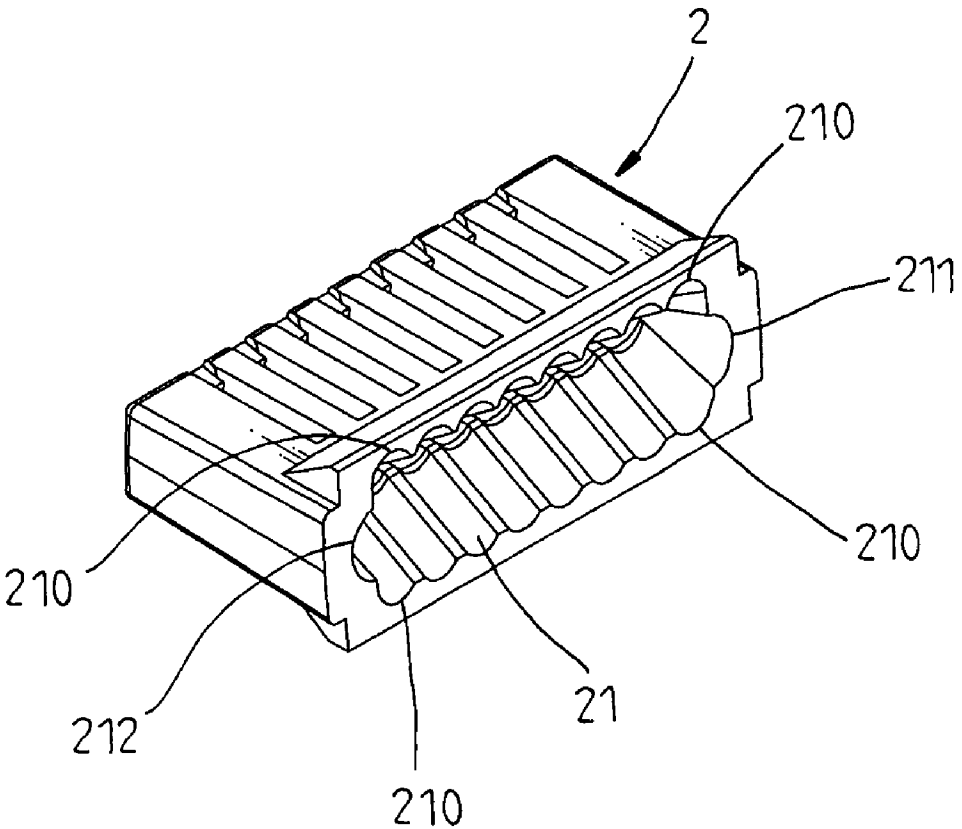
FIG. 6 is an oblique rear elevation in an enlarged scale of the load bar shown in FIG. 5.
Figure 7:
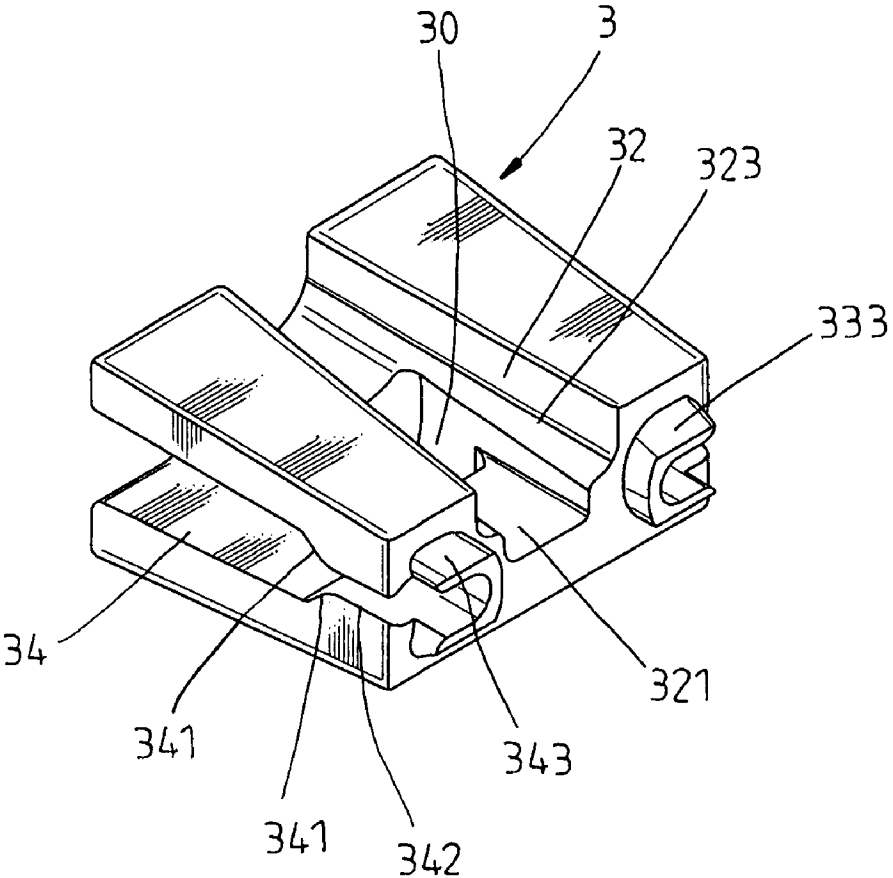
FIG. 7 is an oblique bottom elevation in an enlarged scale of the cable organizer shown in FIG. 5.
Figure 8:
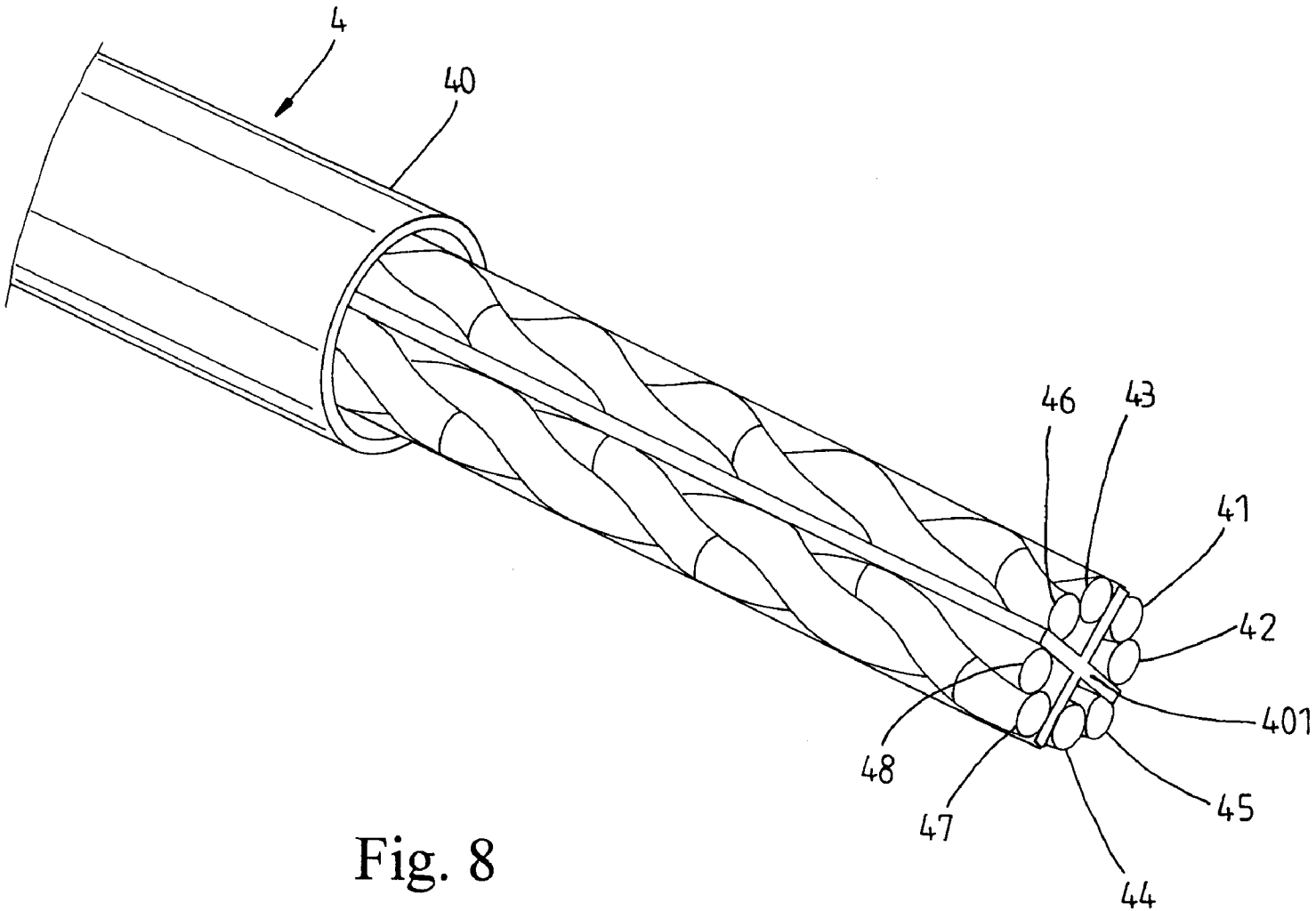
FIG. 8 is a perspective view of a cable according to the present invention.
Figure 9:
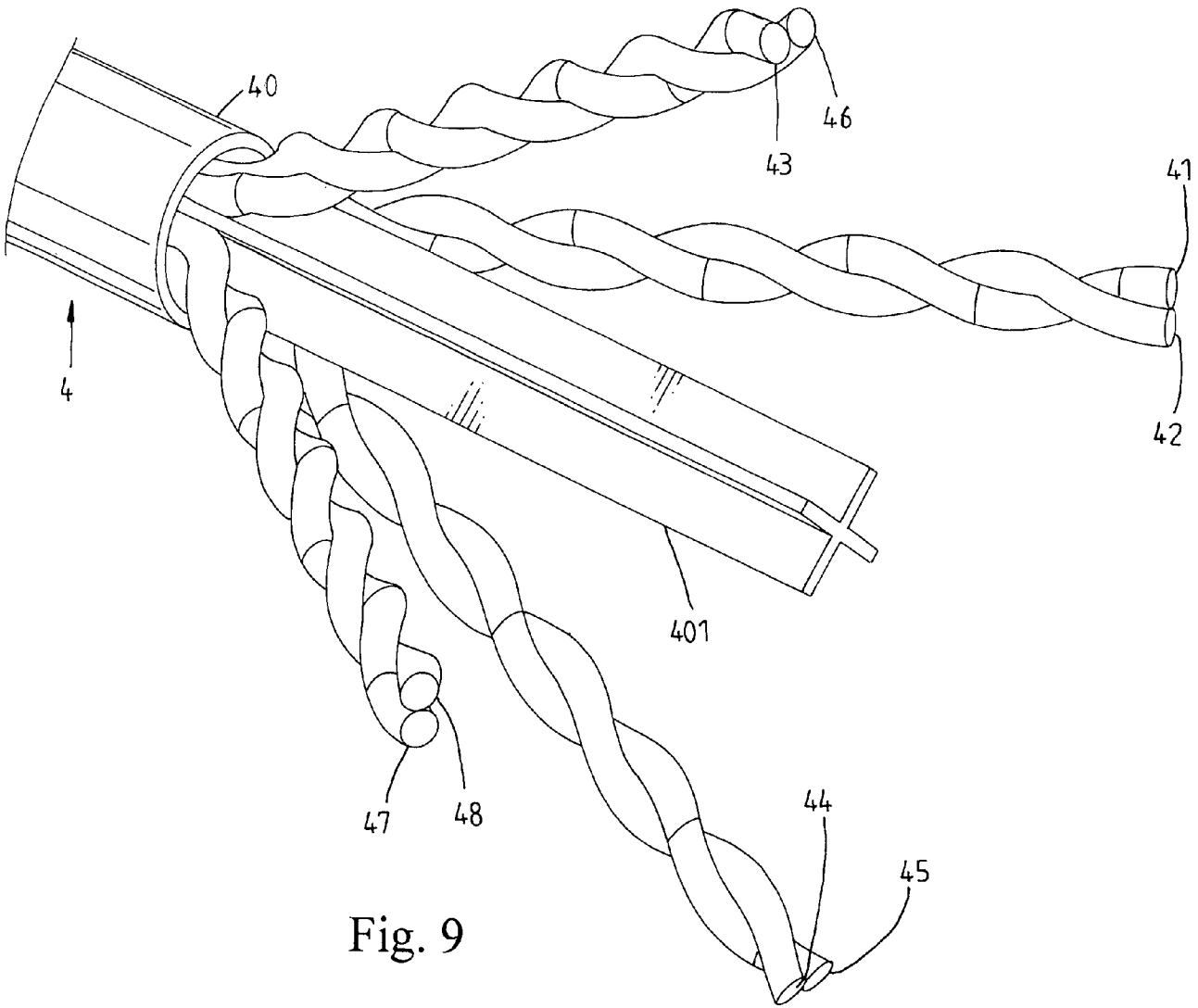
FIG. 9 corresponds to FIG. 8, showing the twisted pairs separated from the partition member.

Referring to FIGS. 5~7, the cable organizer 3 has a longitudinally extending top guide groove 31, a longitudinally extending bottom guide groove 32, a bottom recess 321 on the front side of the bottom guide groove 32 (see FIG. 7), a longitudinally extending left guide groove 33, a longitudinally extending right guide groove 34, a vertical opening hole 30 in communication between the top guide groove 31 and the bottom guide groove 32, and two guide flanges 333 and 343 respectively protruded from the front wall thereof around the left guide groove 33 and the right guide groove 34. The left guide groove 33 and the right guide groove 34 slope downwards from the rear side toward the front side, each having a front end terminating in a tapered guide surface portion 331 or 341 and a narrow groove section 332 or 342. During installation of the plug, the guide flanges 333 and 343 of the cable organizer 3 are respectively inserted into the guide grooves 211 and 212 in the rear open chamber 21 of the load bar 2 (see FIG. 6), allowing insertion of the fourth wire 44 and fifth wire 45 of the cable 4 into the top guide groove 31, the third wire 43 and sixth wire 46 of the cable 4 into the bottom guide groove 32 (see FIGS. 16 and 17), the first wire 41 and second wire 42 into the right guide groove 34 (see FIGS. 13~17), and the seventh wire 47 and eighth wire 48 into the left guide groove 33 (see FIGS. 13~17). After insertion of the fourth wire 44 and fifth wire 45 of the cable 4 into the top guide groove 31, the fourth wire 44 and fifth wire 45 of the cable 4 go through the vertical opening hole 30 into the bottom guide groove 32 and then go out of the bottom guide groove 32 over the bottom recess 321 (see FIG. 15).

Figure 20:
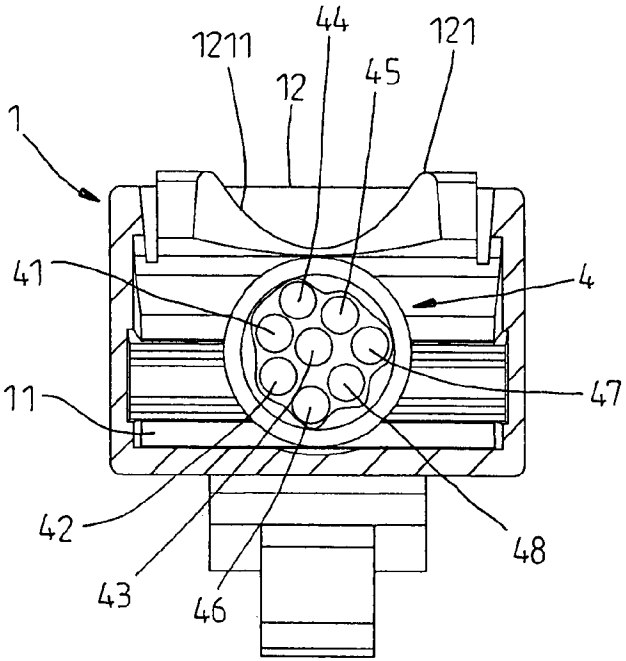
FIG. 20 is a schematic sectional front view of FIG. 18.
Figure 19:
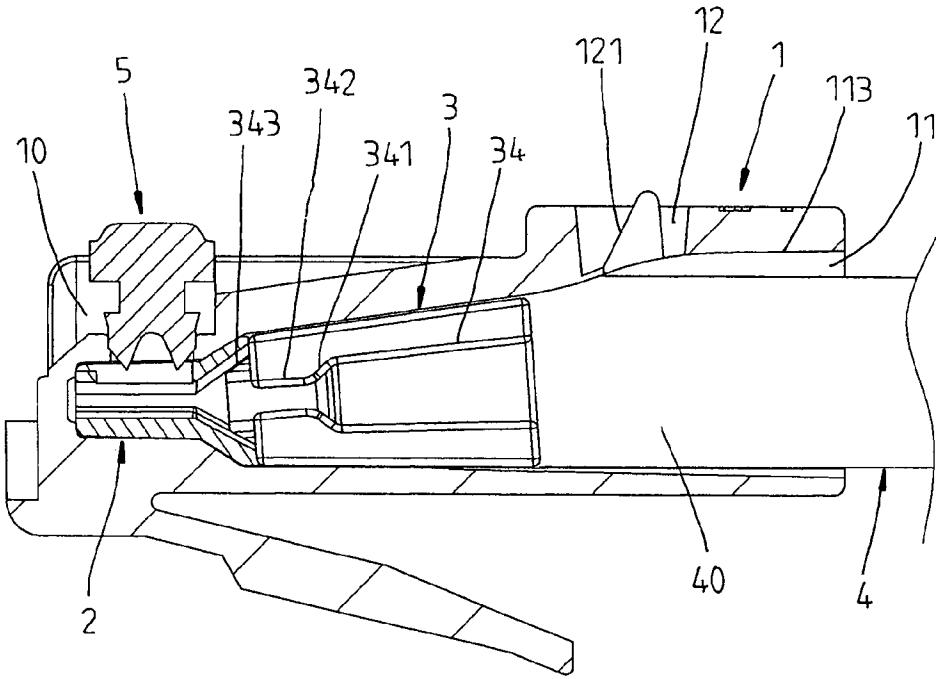
FIG. 19 is a schematic sectional side view of FIG. 18.
Figure 22:
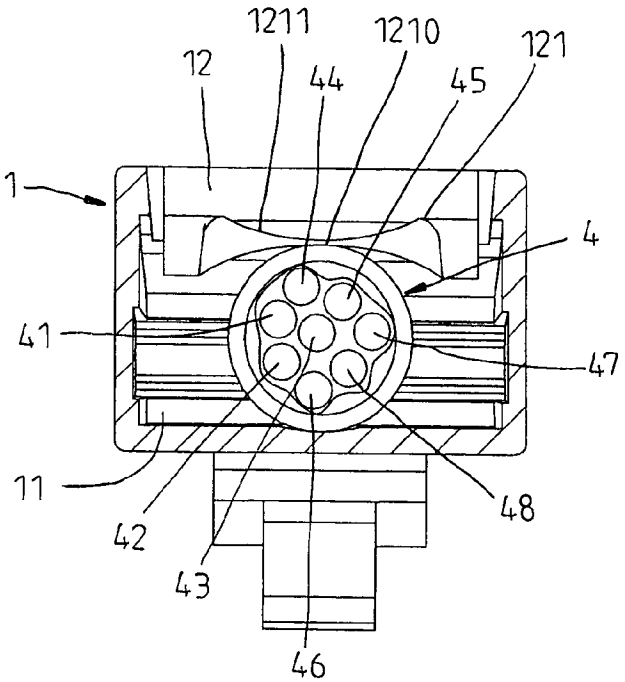
FIG. 22 is a schematic section front view of FIG. 21.
Figure 21:
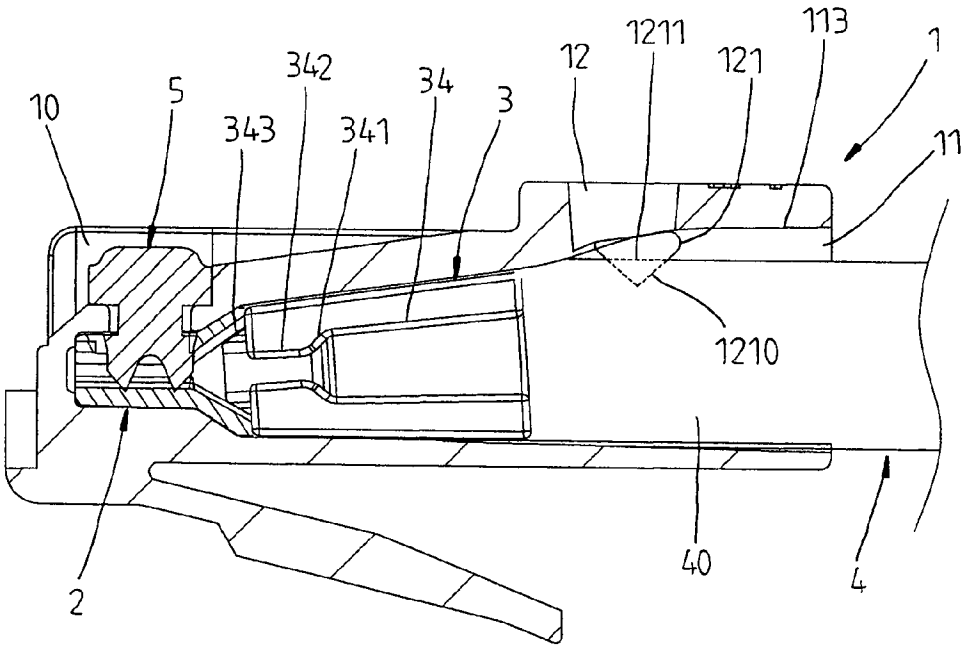
FIG. 21 corresponds to FIG. 19, showing the holding down block forced into engagement with the periphery of the cable.

Referring to FIGS. 5, 19 and 20, the holding down block 121 is formed integral with one of the four peripheral sidewalls of the locating slot 12 and suspending in the locating slot 12, and spaced from the other three peripheral sidewalls 122,123,124 of the locating slot 12 at a distance so that the holding down block 121 can conveniently be stamped.

Referring to FIG. 6, the load bar 2 further has two guide grooves 211 and 212 formed in the rear open chamber 21 at two opposite lateral sides. The rear open chamber 21 of the load bar 2 is a tapered chamber, having 8 wire grooves 210 sloping in one direction and symmetrically formed in each of the top and bottom sides in communication with the wire slots 20 respectively By means of the wire grooves 210, the 8 wires 41~48 of the cable 4 are smoothly and accurately guided into the respective wire slots 20.

Figure 10:
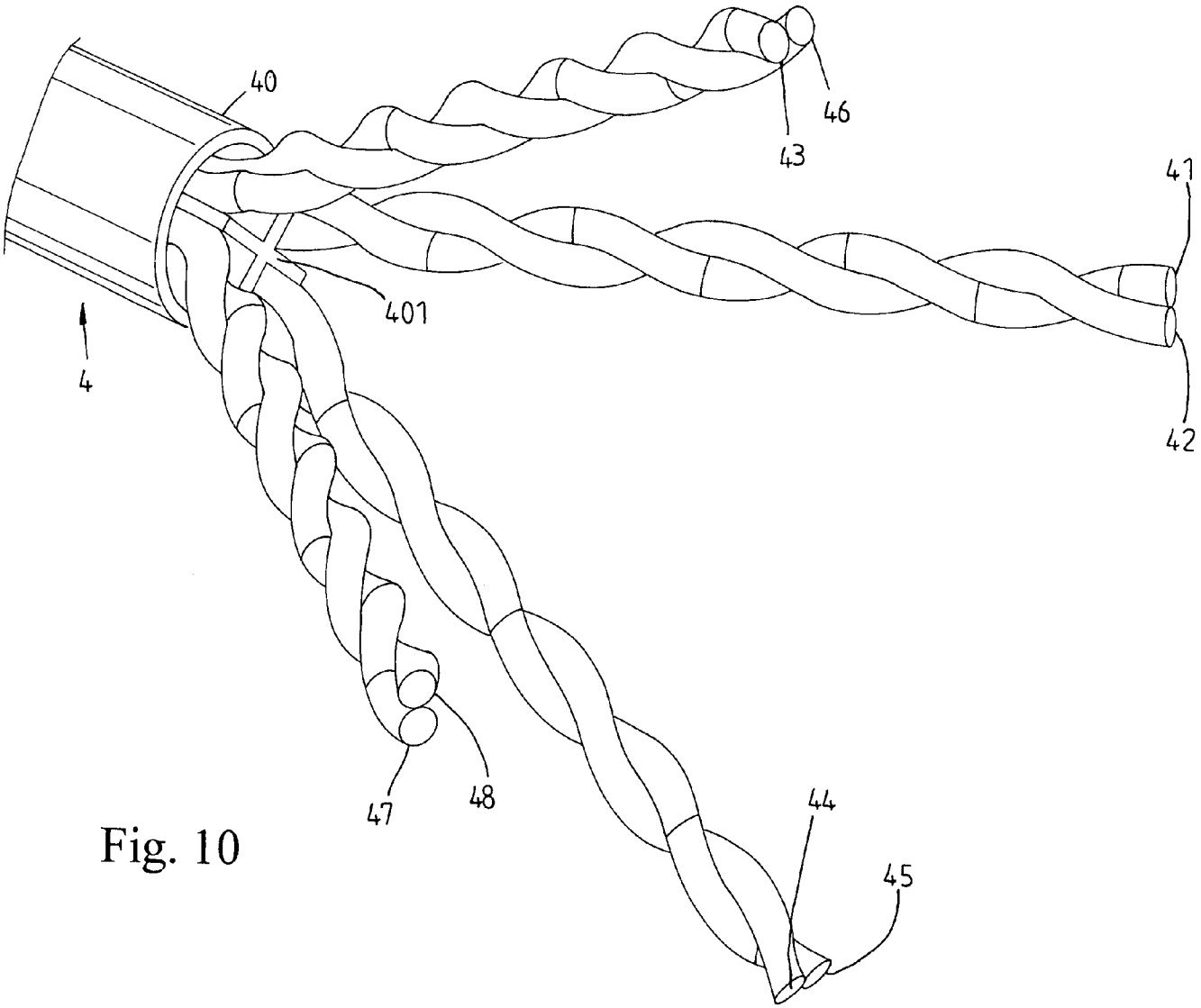
FIG. 10 corresponds to FIG. 9, showing the exposed part of the partition member cut off.
Figure 11:
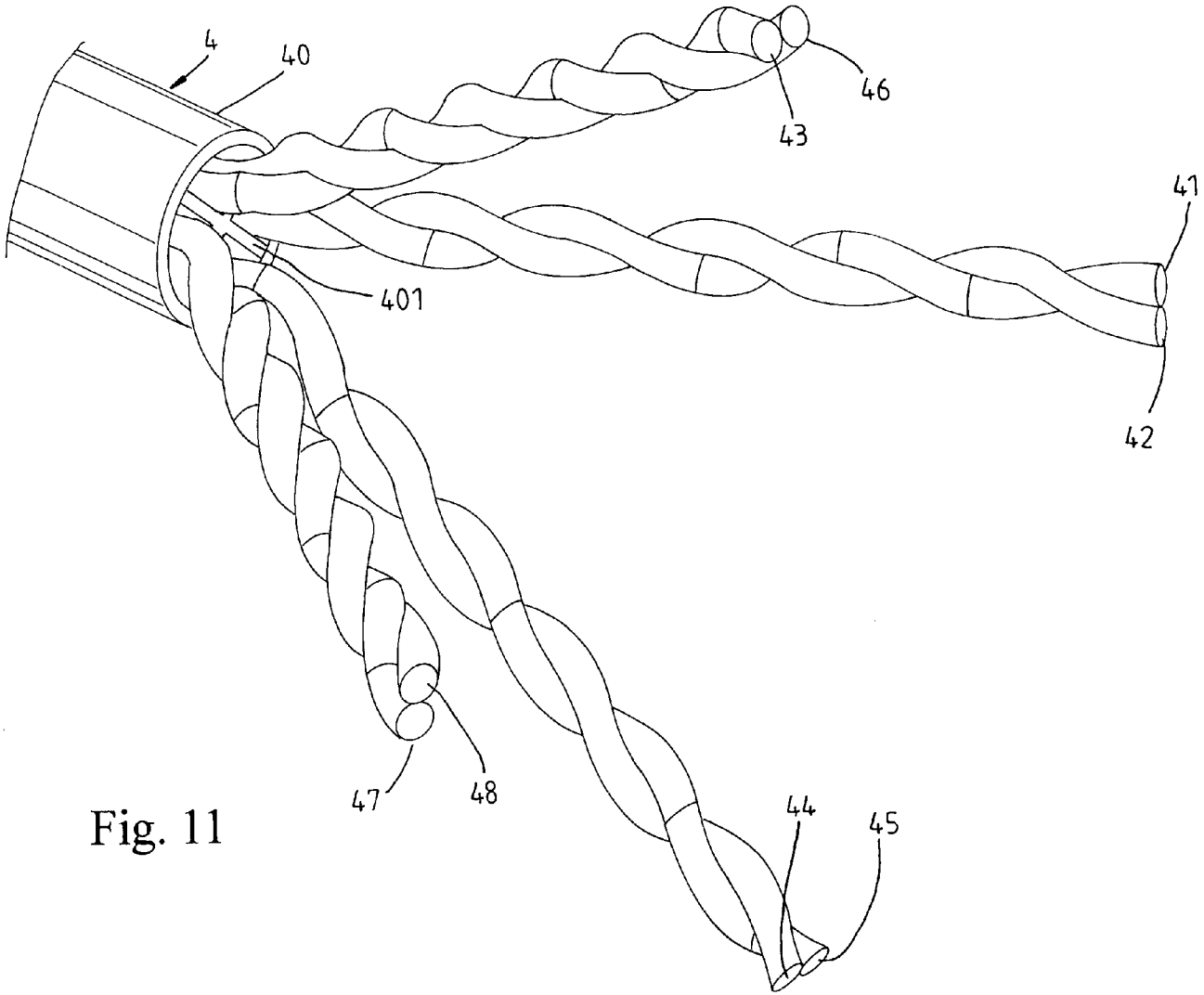
FIG. 11 corresponds to FIG. 10, showing the first and second wires and the seventh and eighth wires arranged in parallel.
Figure 12:
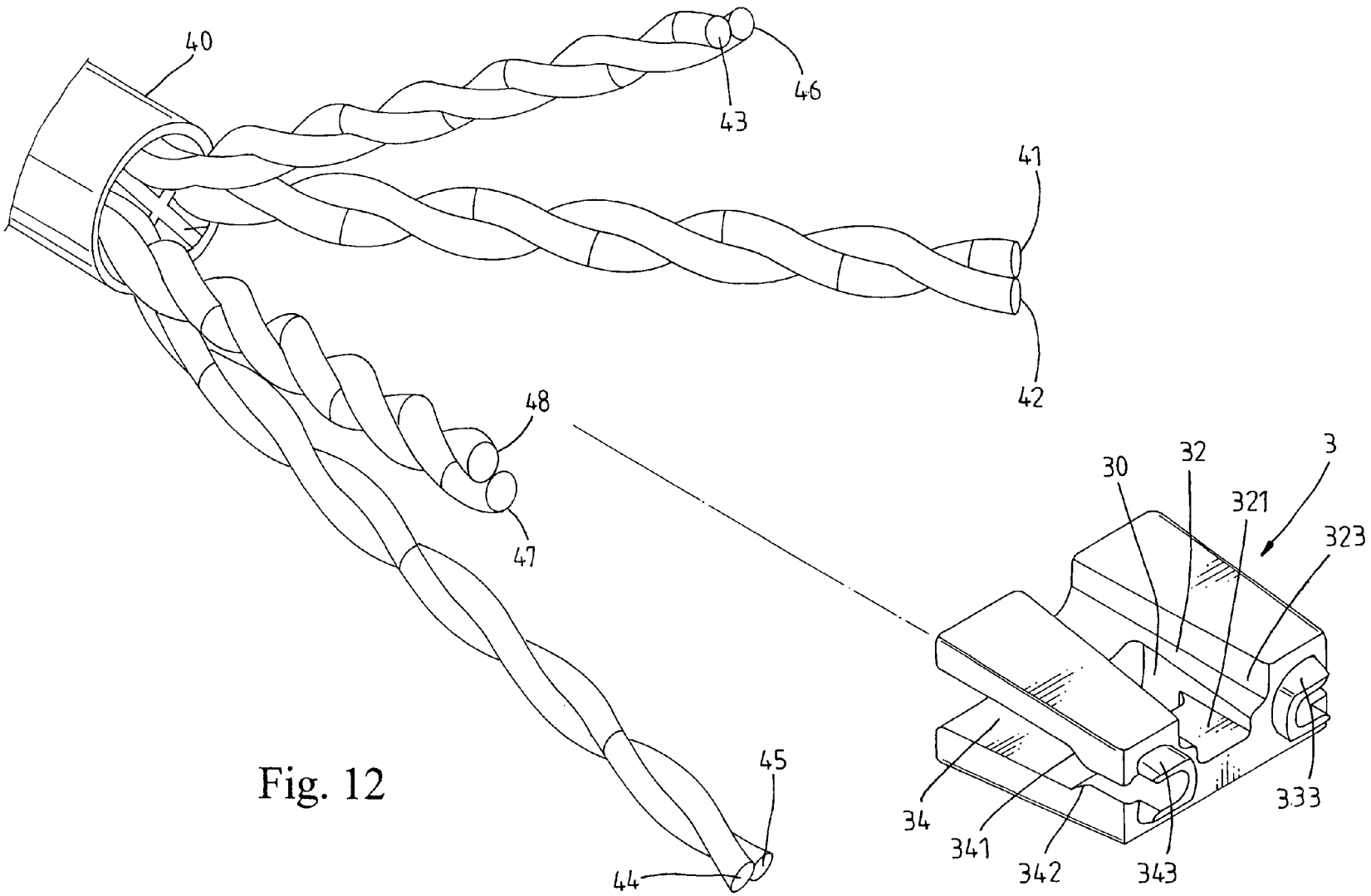
FIG. 12 is an exploded view of the cable organizer and the cable corresponding to FIG. 11.
Figure 13:
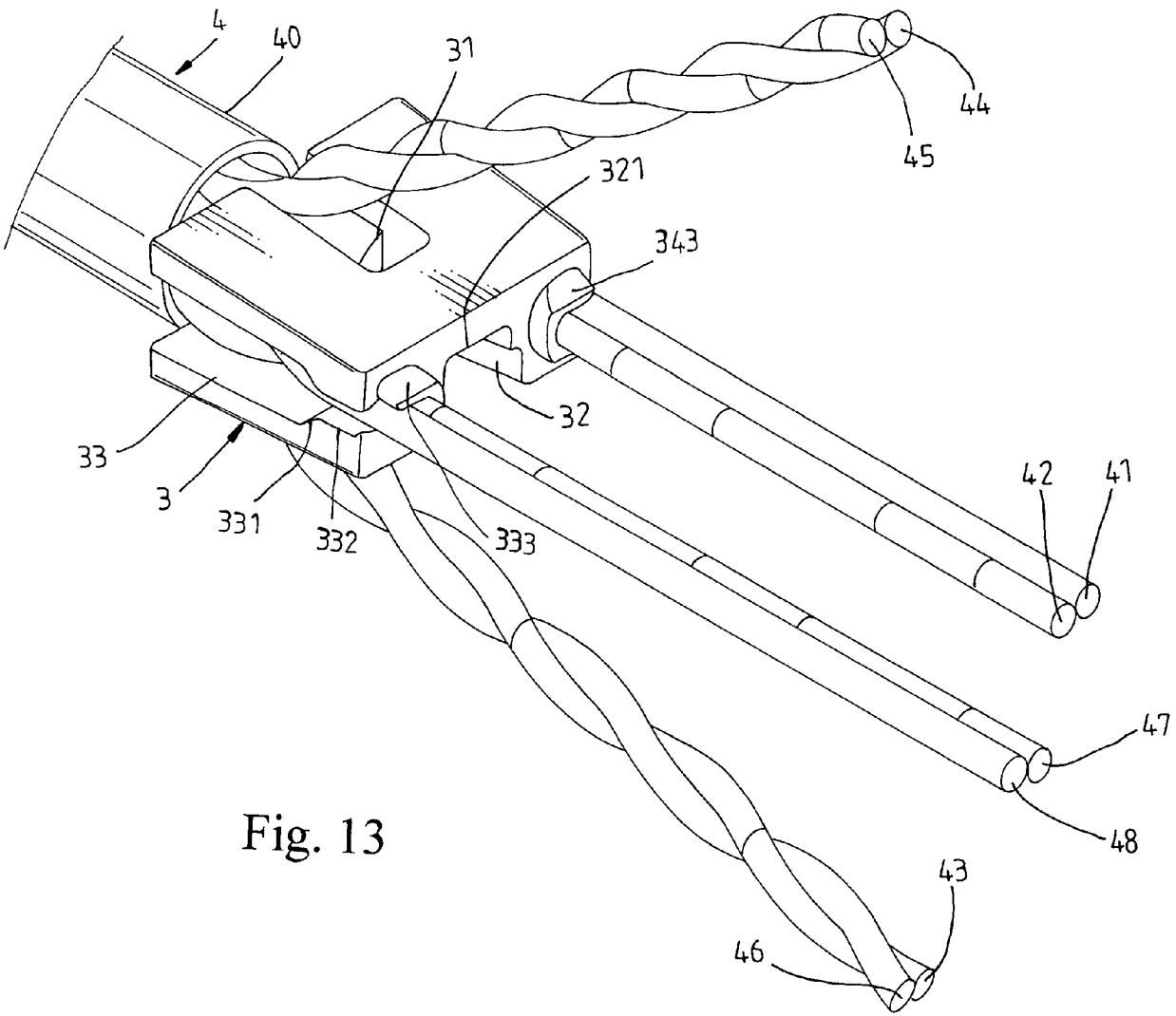
FIG. 13 corresponds to FIG. 12, showing the cable organizer attached to the wires of the cable.
Figure 14:
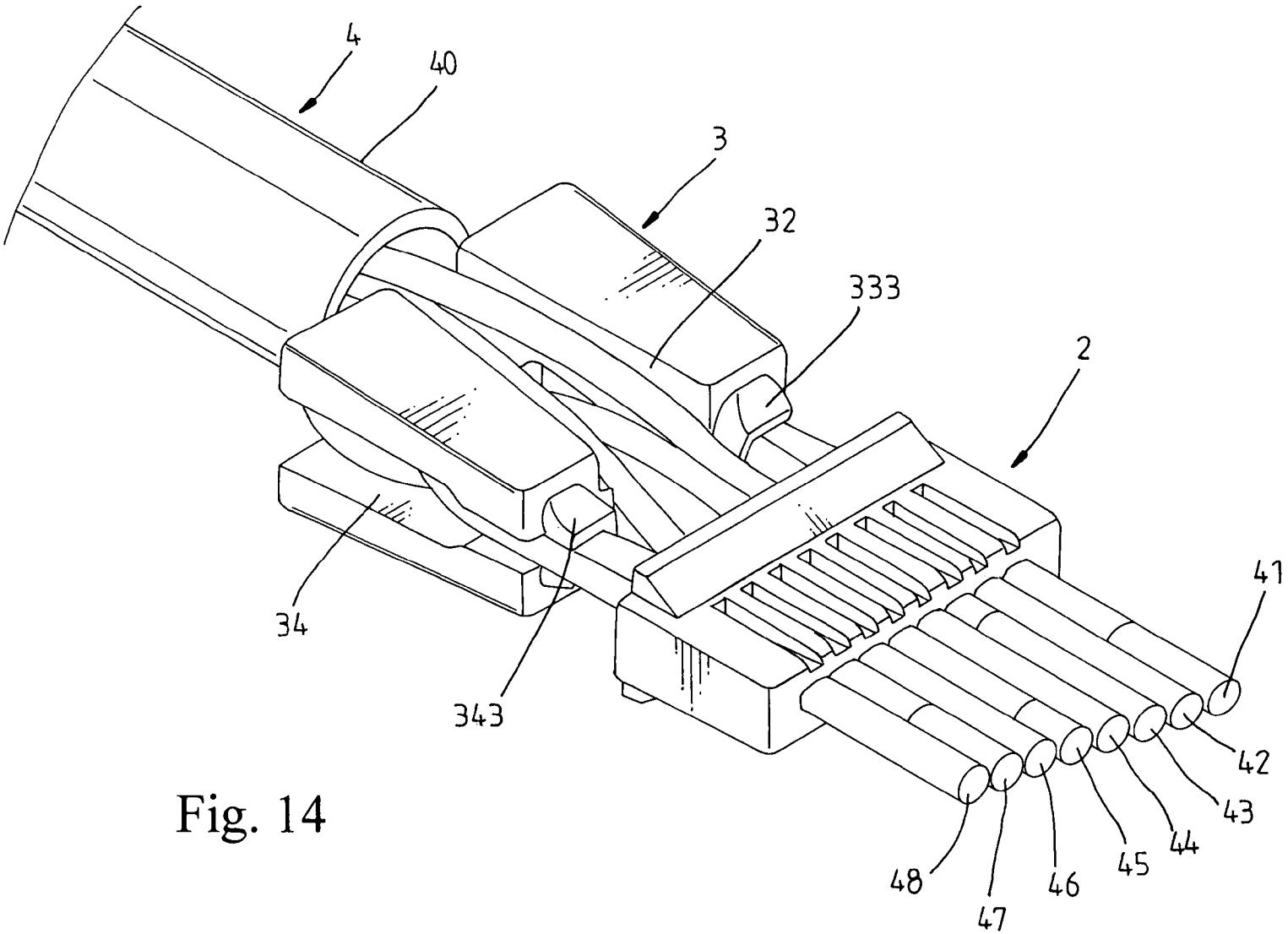
FIG. 14 corresponds to FIG. 13, showing wires of the cable-inserted through the load bar.
Figure 15:
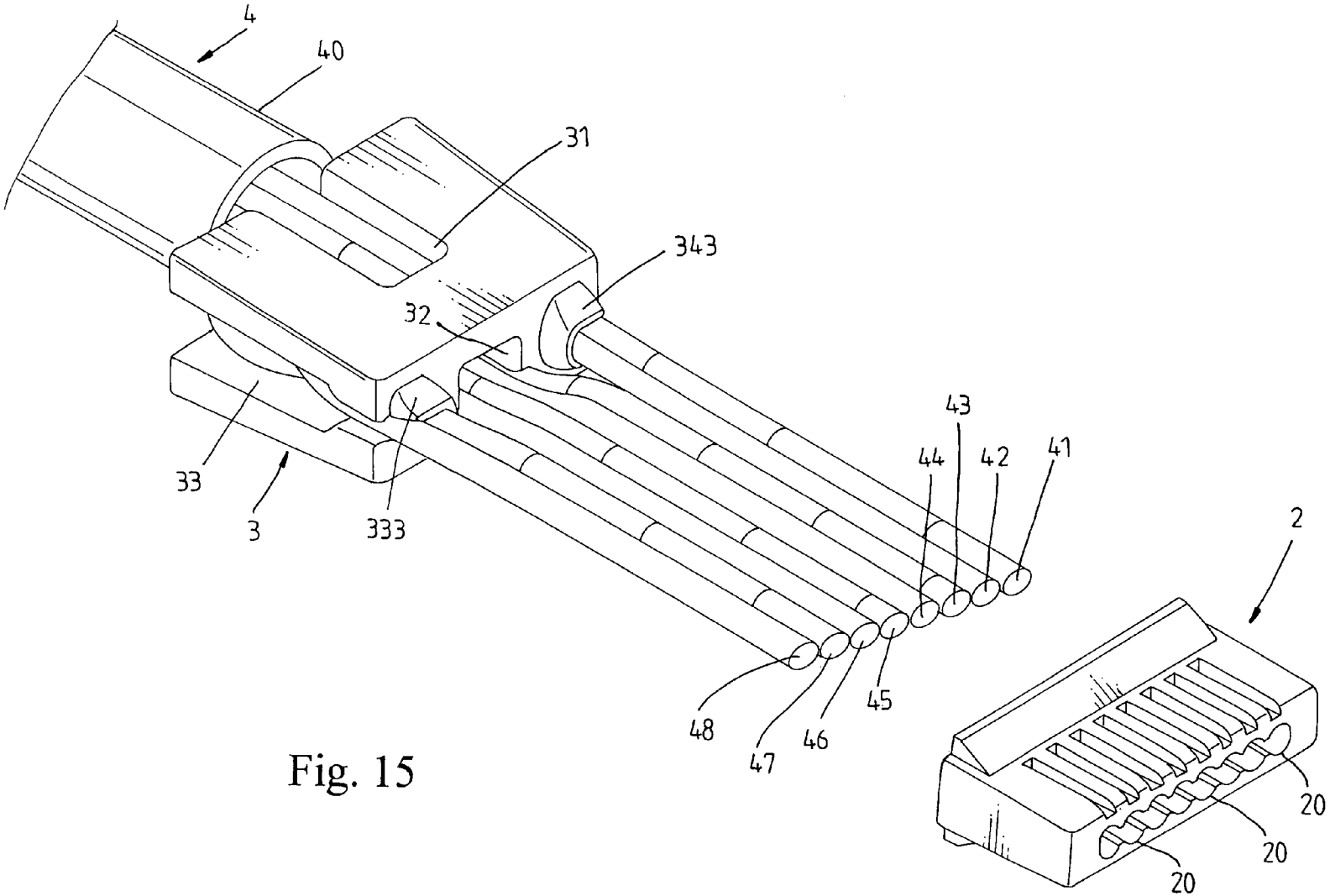
FIG. 15 illustrates the cable organizer fastened to the wires of the cable, the load bar separated from the wires of the cable according to the present invention.
Figure 16:
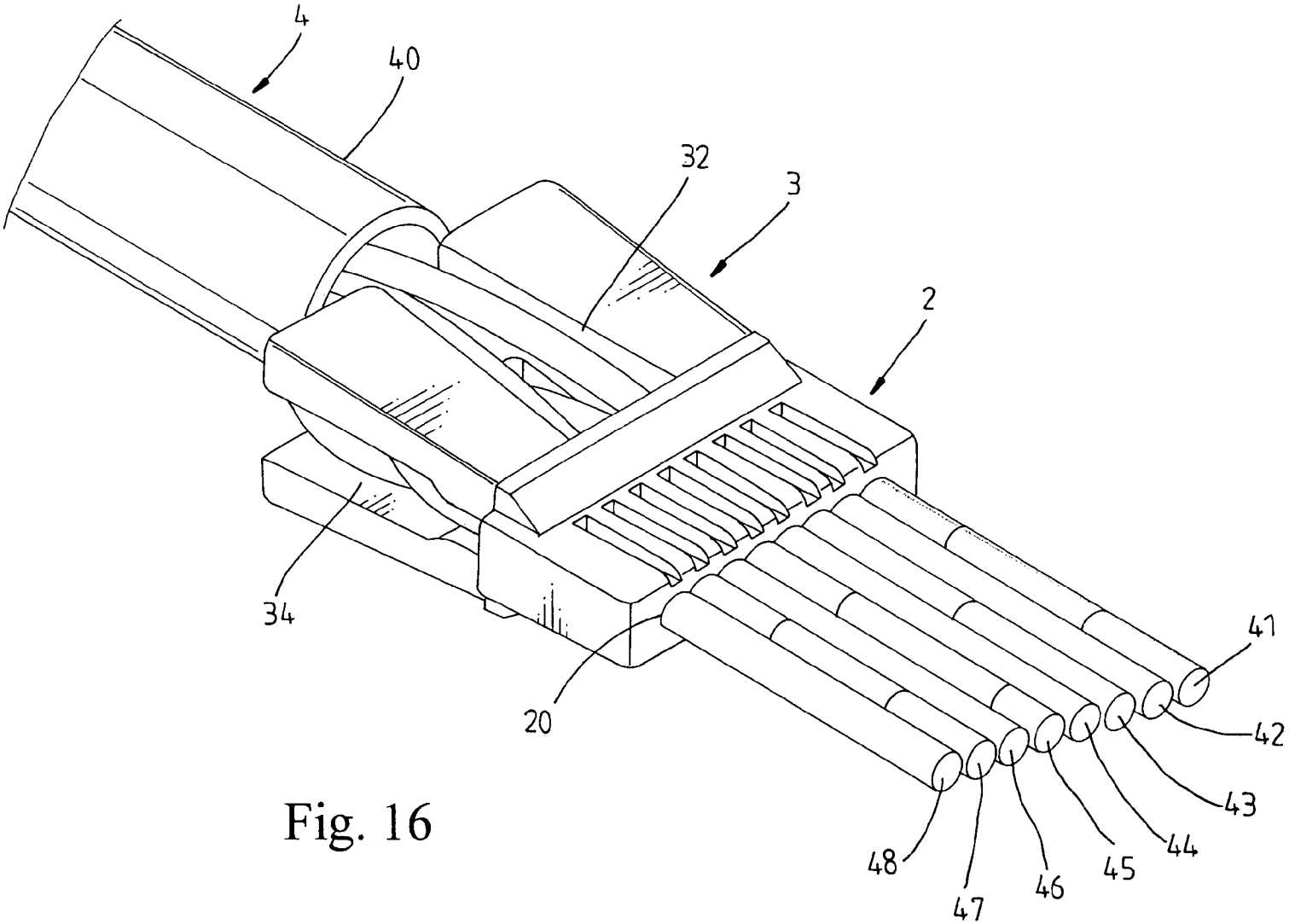
FIG. 16 illustrates the cable organizer and the load board fastened to the wires of the cable according to the present invention.
Figure 17:
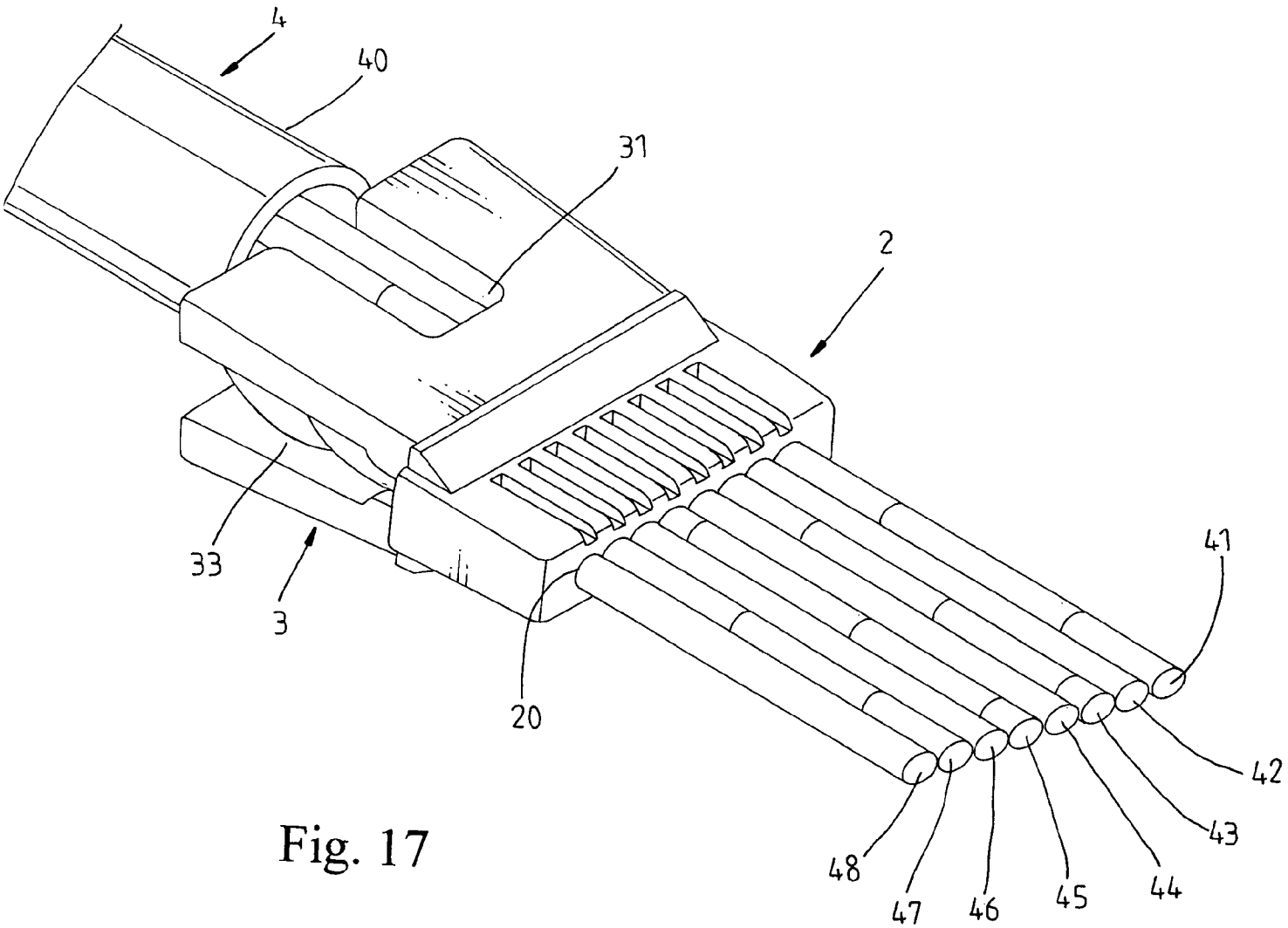
FIG. 17 is an oblique bottom view of FIG. 16.
Figure 18:
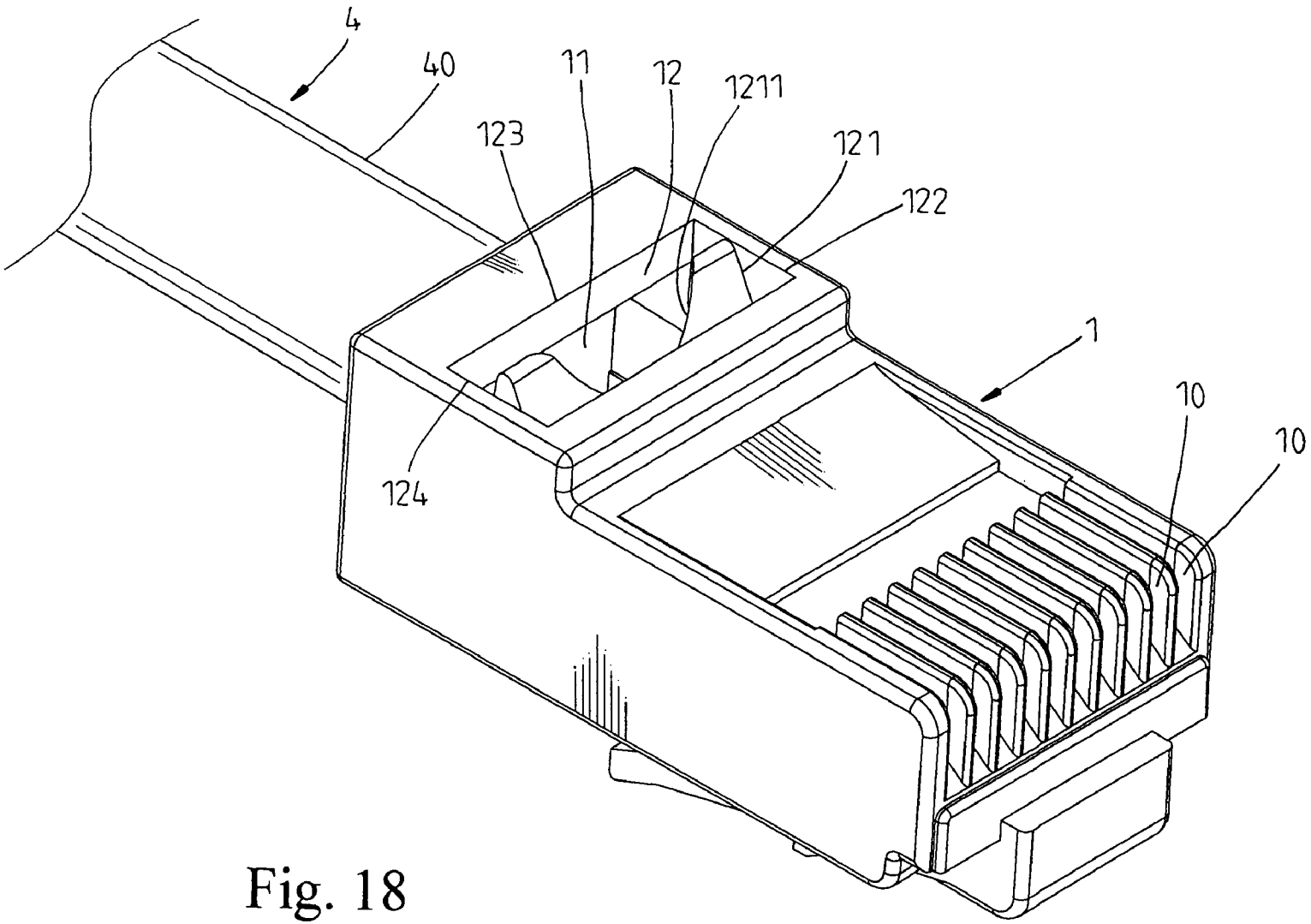
FIG. 18 illustrates the high frequency plug fastened to the wires of the cable before stamping of the holding down block.

Before installation, cut off the outer insulative 40 of the cable 4 subject to a predetermined length (see FIG. 8), and then separate the twisted pairs 41,42; 43,46; 47,48 (see FIG. 9), and then cut off the exposed partition member 401 of the cable 4 (see FIG. 10). During installation, as shown in FIGS. 11~13, the first wire 41 and second wire 42 of the cable 4 are inserted through the right guide groove 34 of the cable organizer 3 out of the front side of the cable organizer 3, the seventh wire 47 and eighth wire 48 of the cable 4 are inserted through the left guide groove 33 of the cable organizer 3 out of the front side of the cable organizer 3, the fourth wire 44 and fifth wire 45 of the cable 4 are inserted through the top guide groove 31 of the cable organizer 3 and then the vertical opening hole 30 into the bottom guide groove 32 and then extended out of the bottom guide groove 32 over the bottom recess 321 (see FIG. 15), and the third wire 43 and sixth wire 46 of the cable 4 are inserted through the bottom guide groove 32 of the cable organizer 3 out of the front side of the cable organizer 3. Thereafter, the front ends of the 8 wires 41~48 of the cable 4 are respectively guided by the wire grooves 210 of the load bar 2 (see FIGS. 14 and 15) into the respective wire slots 20, and then the guide flanges 333 and 343 of the cable organizer 3 are respectively inserted into the guide grooves 211 and 212 in the rear open chamber 21 of the load bar 2 (see FIG. 6), and then the load bar 2 with the cable organizer 3 and the cable 4 are into the accommodation chamber 11 of the housing 1 (see FIG. 19), keeping the load bar 2 and the cable organizer 3 respectively accommodated in the accommodation chamber 11. Thereafter, the prepared 8 metal contacts 5 are respectively inserted into the wire slots 10 from the top side, and forced to cut into the wires 41~48 of the cable 4 respectively and to make a respective electric contact, and then the holding down block 121 of the housing 1 is stamped into position to force the bottom edge 1210 into engagement with the periphery of the cable 4, thereby affix the cable 4 to the housing (see FIGS. 21 and 22). Because the first and second wires 41 and 42 and the seventh and eighth wires 47 and 48 are respectively positioned in the left guide groove 33 and the right guide groove 34, both pairs are isolated. Further, because of the effect of the vertical opening hole 30, the cross talk between the third and sixth wires 43 and 46 and the fourth and fifth wires 44 and 45 is enhanced to achieve de-embedded effect, thereby improving the transmission quality.

Further, the cable organizer 3 is molded from an electrically conductive, EMI/RFI shielding material, for example, metal powder plastic material.

Further, the cable organizer 3 has two recessed bearing portions 323 formed in the bottom guide groove 32 at two sides of the bottom recess 321 for supporting the third wire 43 and the sixth wire 46 respectively.

During mounting of the 8 wires 41~48 in the cable organizer 3, the following two points must be taken into account.

1. Pair 44;45 should not have twist, the wires should go in parallel above the opening hole 30 in the organizer 3 in order to "see" the pair 43;46 and increase the cross talk.

2. Side pairs 42;42 and 47;48 should have some twist.

Figure 23:
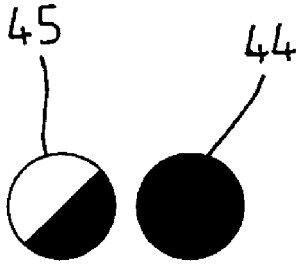
FIG. 23 is a schematic front plain view of the fourth and fifth wires of the cable according to the present invention.
Figure 24:
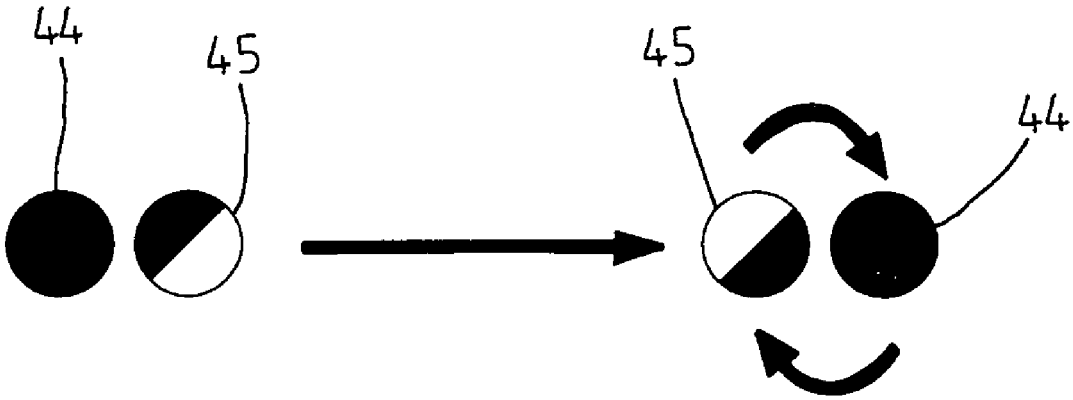
FIG. 24 is a schematic front plain view of the ½-turn twist of pair in the initial position and the final position.
Figure 25:
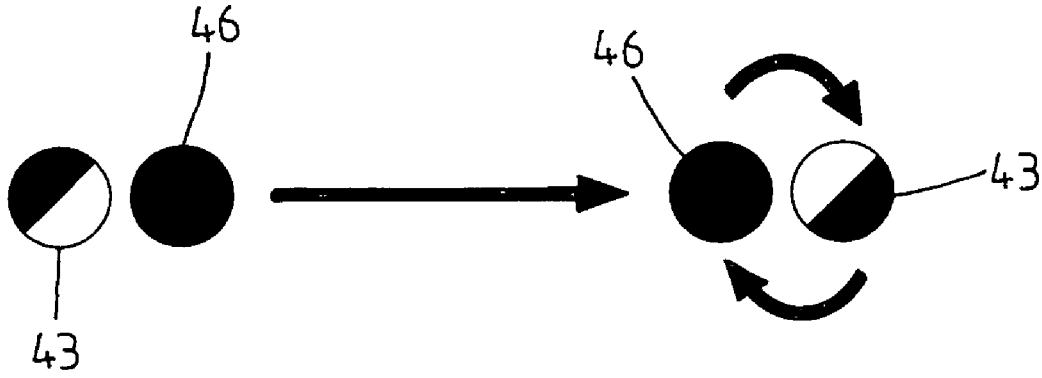
FIG. 25 is a schematic front plain view of the ½-turn twist of pair in the initial position and the final position.
Figure 26:
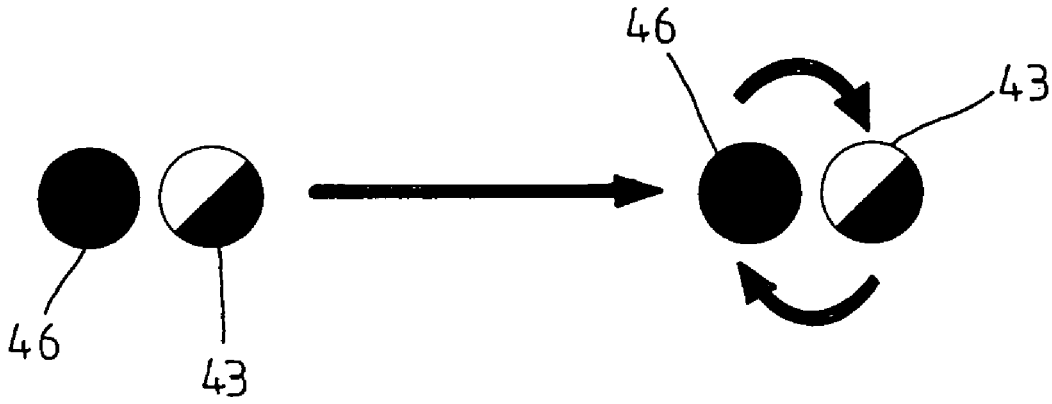
FIG. 26 is a schematic front plain view of the 1-turn twist of pair in the initial position and the final position.
Figure 27:
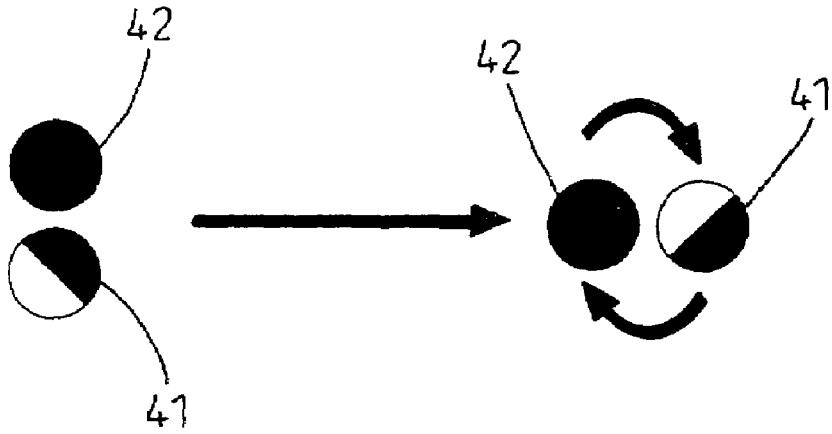
FIG. 27 is a schematic front plain view of the ¼-turn twist of pair in the initial position and the final position.
Figure 28:
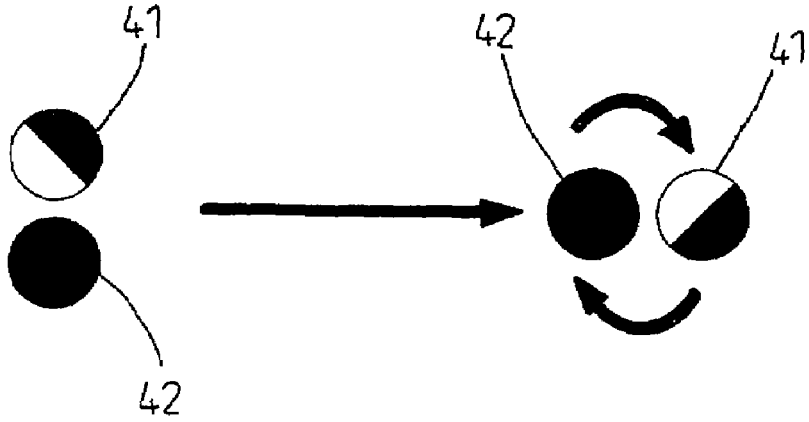
FIG. 28 is a schematic front plain view of the 1¼-turn twist of pair in the initial position and the final position.

Further, during mounting of the 8 wires 41~48 in the cable organizer 3, pair 44;45 should not have twist, and the maximum permitted twist of pair 44;45 is ½ turn (see FIG. 23). FIG. 24 is a schematic front plain view of the ½-turn twist of pair 44;45 in the initial position and the final position. The maximum required twist of pair 43;46 is ½ turn. The maximum permitted twist of pair 43;46 is 1 turn. FIG. 25 is a schematic front plain view of the ½-turn twist of pair 43;46 in the initial position and the final position. FIG. 26 is a schematic front plain view of the 1-turn twist of pair 43;46 in the initial position and the final position. The maximum required twist of pair 41;42 is ¾ turn. The maximum permitted twist of pair 41;42 is 1¼ turn. FIG. 27 is a schematic front plain view of the ¼-turn twist of pair 41;42 in the initial position and the final position. FIG. 28 is a schematic front plain view of the 1¼-turn twist of pair 41;42 in the initial position and the final position.

Figure 29:
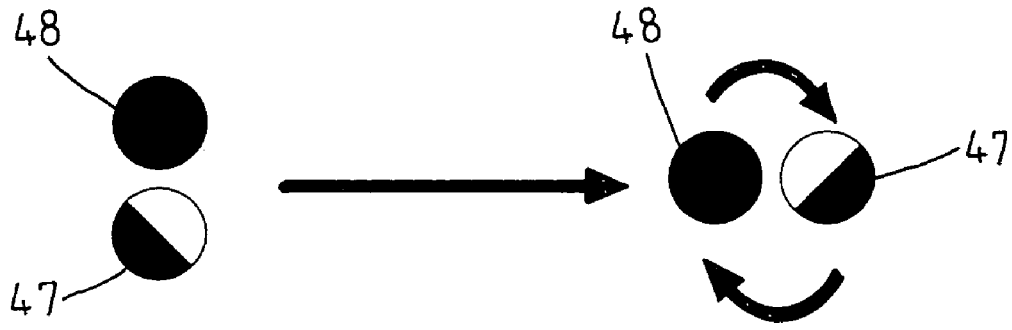
FIG. 29 is a schematic front plain view of the ¾-turn twist of pair in the initial position and the final position.
Figure 30:
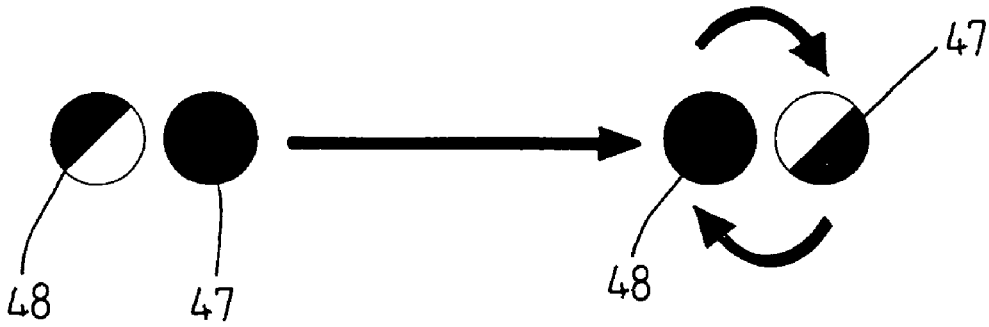
FIG. 30 is a schematic front plain view of the 1½-turn twist of pair in the initial position and the final position.

The maximum required twist of pair 47;48 is ¾ turn. The maximum permitted twist of pair 47;48 is 1½ turn. FIG. 29 is a schematic front plain view of the ¾-turn twist of pair 47;48 in the initial position and the final position. FIG. 30 is a schematic front plain view of the 1½-turn twist of pair 47;48 in the initial position and the final position.

As described above, the invention provides a high frequency plug that has the benefits as follows:

1. The first and second wires 41 and 42 and the seventh and eighth wires 47 and 48 are respectively positioned in the left guide groove 33 and the right guide groove 34, both pairs are isolated. Further, because of the effect of the vertical opening hole 30, the cross talk between the third and sixth wires 43 and 46 and the fourth and fifth wires 44 and 45 is enhanced to achieve de-embedded effect, thereby improving the transmission quality.

2. The cable organizer 3 is molded from plastic with electrically conductive material or EMI RFI shielding material, for example, metal powder plastic material.

3. The housing 1 has a holding down block 121 protruded from one peripheral wall of the locating slot 12. The holding down block 121 has a smoothly arched top recessed portion 1211 against which a tool is driven to force the holding down block 121 into the desired position to hold down the cable 4, maintaining the twist pitch of the twisted pairs 44,45; 43,46; 41,42; 47,48 and normal signal transmission function of the cable 4.

4. After insertion of the wires 41~48 of the cable 4 through the cable organizer 3 and the load bar 2, the cable organizer 3 is connected to the load bar 2 by inserting the guide flanges 333 and 343 of the cable organizer 3 into the guide grooves 211 and 212 in the rear open chamber 21 of the load bar 2, and then the load board 2 with the cable organizer 3 and the cable 4 are inserted through the rear opening 11 into the inside of the housing 1 to have the load bar 2 and the cable organizer 3 be respectively accommodated in the front load bar chamber 111 and the intermediate cable organizer chamber 112, and then the holding down block 121 of the housing 1 is stamped into the engagement position to hold down the cable 4, thereby completing the installation.

5. The load bar 2 has sloping wire grooves 210 on the top and bottom walls inside the accommodation chamber 21 for guiding the wires 41~48 of the cable 4 into the respective wire slots 20 so that the wires 41~48 of the cable 4 can easily and accurately be inserted into the respective wire slots 20.

6. The housing (1) has special cable strain relief fixture allowing effectively functionality according to relevant standards. The fixture keep the cable structure and prevent performance degradation.

7. Cable organizer (3) designed to receive multiple twisted pairs from standard data cable from one side and to bring the wires to the other side in special order according to appropriate standards (T568A/B). Construction of the cable organizer (3) allows maximum crosstalk reduction and stabilizing between the twisted pairs without impacting or other electrical parameters like RL or IL. The part material is plastic or metal powder plastic.

8. The load bar (2) allows keeping the arranged in special order wires during termination process and aligns the contacts (IDC) precisely and consistently.

9. The plug construction allows assembly of high quality patch cords using standard patch cable. The dimensions of the parts allow precision connection with each other and keep the cable and twisted pairs structure during the assembly process.

Figure 31:
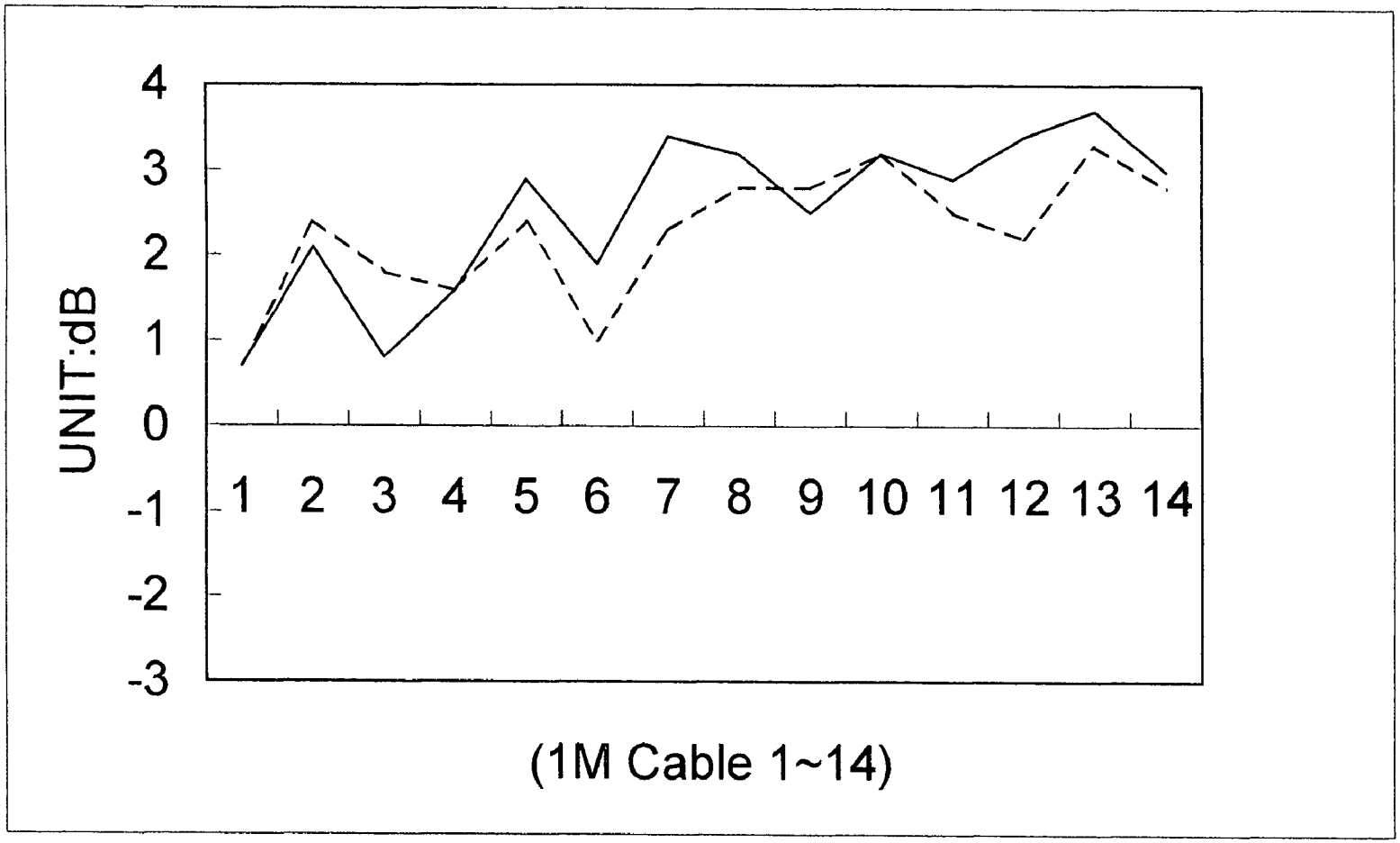
FIG. 31 is a (dB) curve obtained from a test made on a high frequency plug sample constructed according to the present invention.

FIG. 31 is a (dB) curve obtained from a test made on a high frequency plug sample constructed according to the present invention. FIG. 32 is a (dB) value statistic chart obtained from a test made on a high frequency plug sample constructed according to the present invention. The test is a category 6 modular plug cord test subject to TIA/ELA568-b.2-1 issued by Telecommunication Industry Association Standards and Technology Department, by means of PSP4300 Cable Analyzer provided by FLUKE networks. The opposite ends of 14 cables are mounted with a respective high frequency plug sample of the present invention, and then the near end (A) and the far end (B) of the assembly were respectively connected to the test instrument for test. In FIG. 31, 1~14 indicate the 14 cables. The (dB) measured from each cable is a positive value, indicating stable quality of each cable and good quality of the high frequency plugs. The curve of the rear line shown in FIG. 32 is a (dB) curve obtained from the near end (A) of the cables 1~14; the curve of the imaginary line is a (dB) curve obtained from the far end (B) of the cables 1~14. As shown in FIG. 31, there is no significant difference among the dB values obtained from the cables 1~14. As shown in FIG. 32, the average of the dB values obtained from the cables 1~14 is 24. This positive value represents stable quality and high performance of the test samples, and therefore the yield rate of the product is high.

Figure 33:
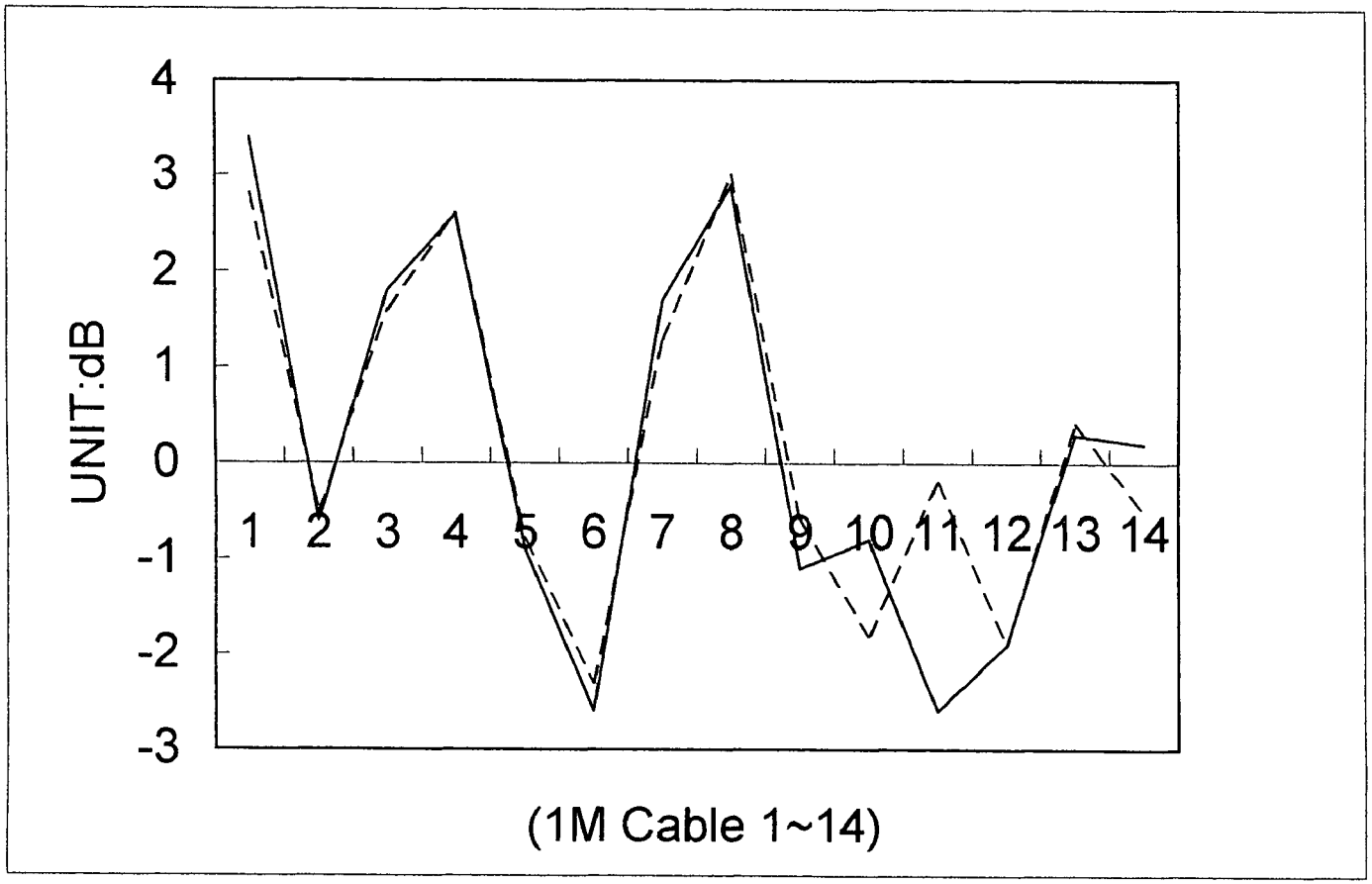
FIG. 33 is a (dB) curve obtained from a test made on a high frequency plug sample constructed according to U.S. patent application Ser. No. 11/447,051.

FIG. 33 is a (dB) curve obtained from a test made on a high frequency plug sample constructed according to U.S. patent application Ser. No. 11/447,051. FIG. 34 is a (dB) value statistic chart obtained from a test made on a high frequency plug sample constructed according to U.S. patent application Ser. No. 11/447,051. This test was performed subject to the same category, same test conditions, and same test instrument. During test, the opposite ends of 14 cables are mounted with a respective high frequency plug sample constructed subject to U.S. patent application Ser. No. 11/447,051, and then the near end (A) and the far end (B) of the assembly were respectively connected to the test instrument for test. In FIG. 33, 1~14 indicate the 14 cables. The (dB) values measured from cables numbered 2, 5, 6, 9, 10, 11 and 12 were negative values, indicating low performance of the high frequency plug samples, and therefore the yield rate of the product according to U.S. patent application Ser. No. 11/447,051 is low. The curve of the rear line shown in FIG. 34 is a (dB) curve obtained from the near end (A) of the cables 1~14; the curve of the imaginary line is a (dB) curve obtained from the far end (B) of the cables 1~14. As shown in FIGS. 33 and 34, the dB value obtained from the samples of U.S. patent application Ser. No. 11/447,051 is 0.2; most dB values obtained from the cables 1~14 are negative values. Unlike the negative results of the prior art design, the dB values obtained from the cables 1~14 according to the present invention are positive values, showing a stable quality and high performance of the present invention, and therefore the yield rate of the present invention is high.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A high frequency plug connected to a 8-wire-cable having four twisted pairs, comprising:

a housing molded from plastics, said housing having an accommodation chamber for accommodating a load bar and a cable organizer, a rear opening hole on a rear side thereof in communication with said accommodation chamber, a locating slot cut through a top wall thereof in communication with said accommodation chamber, and 8 wire slots cut through the top wall in communication with said accommodation chamber and arranged in parallel for the positioning of a respective metal contact;

a load bar accommodated in said accommodation chamber of said housing, said load bar having 8 wire slots longitudinally formed in a front side thereof and arranged in parallel for receiving the 8 wires of the four twisted pairs of said cable, and a rear open chamber through which the 8 wires of the four twisted pairs of said 8-wire cable are inserted into the wire slots of said load bar, the wire slots of said load bar each having an open top side; and a cable organizer accommodated in said accommodation chamber of said housing, said cable organizer having a longitudinally extending top guide groove located to guide fourth and fifth wires of said 8-wire cable into said load bar, a longitudinally extending bottom guide groove located to guide third and sixth wires of said 8-wire cable, a bottom recess on a front side of said bottom guide groove, a longitudinally extending right guide groove located to guide seventh and eighth wires of said 8-wire cable, a longitudinally extending left guide groove located to guide first and second wires of said 8-wire cable, and a vertical opening hole in communication between said top guide groove and said bottom guide groove located to guide fourth and fifth wires of said 8-wire cable from said top guide groove into said bottom guide groove.

2. The high frequency plug as claimed in claim 1, wherein the fourth and fifth wire of said 8-wire cable are kept in parallel in said cable organizer.

3. The high frequency plug as claimed in claim 1, wherein the first wire and second wire of said 8-wire cable are kept twisted in said cable organizer;

the seventh wire and eighth wire of said 8-wire cable are kept twisted in said cable organizer.

4. The high frequency plug as claimed in claim 1, wherein said cable organizer is made out of a EMI/RFI shielding material.

5. The high frequency plug as claimed in claim 1, wherein said cable organizer has two recessed bearing portions formed in said bottom guide groove at two sides of said bottom recess for supporting the third wire and sixth wire of said 8-wire cable respectively.

6. The high frequency plug as claimed in claim 1, wherein said load bar is a tapered bar.

7. The high frequency plug as claimed in claim 1, wherein said left guide groove and said right guide groove of said cable organizer slope downwards from a rear side toward a front side, each having a front end terminating in a tapered guide surface portion and a narrow groove section; wherein said load bar has two guide grooves formed in the rear open chamber thereof at two opposite lateral sides; said cable organizer further has two guide flanges respectively protruded from a front wall thereof around said left guide groove and said right guide groove and respectively engaged into the guide grooves in the rear open chamber of said load bar.

8. The high frequency plug as claimed in claim 1, wherein said load bar further has two guide grooves formed in the rear open chamber thereof at two opposite lateral sides, the rear open chamber of said load bar being a tapered chamber and having 8 wire grooves obliquely sloping upwards in a top side and 8 wire grooves obliquely sloping downwards in a bottom side in communication with the wire slots of said load bar respectively.

9. The high frequency plug as claimed in claim 1, wherein said cable organizer is made out of plastic with electrically insulative material.

10. The high frequency plug as claimed in claim 1, wherein said housing comprises a holding down block formed integral with one peripheral wall of said locating slot and suspending in said locating slot, said holding down block having a bottom edge that touches the periphery of said 8-wire cable, and a smoothly arched top recess against which a tool means is operated to force said holding down block into position where said holding down block holds down said 8-wire cable in said housing.

11. The high frequency plug as claimed in claim 10, wherein said holding down block is formed integral with one of four peripheral sidewalls of said locating slot and suspending in said locating slot and kept spaced from the other three peripheral sidewalls of said locating slot at a distance.

* * * * *